United States Patent [19]

Lehrman

[11] Patent Number: 4,956,928

[45] Date of Patent: Sep. 18, 1990

[54] APPARATUS FOR SECURING AN IRON TO AN IRONING BOARD COVER

[76] Inventor: David Lehrman, 207 Barclay Cir., Cheltenham, Pa. 19012

[21] Appl. No.: 295,867

[22] Filed: Jan. 11, 1989

[51] Int. Cl.[5] ..... D06F 79/00

[52] U.S. Cl. ..... 38/107; 38/104; 38/140; 248/117.6; 248/205.2; 248/505; 2/DIG. 6

[58] Field of Search ..... 2/DIG. 6; 38/104, 140, 38/107; 248/117.2, 117.6, 187, 177, DIG. 2, 176, 154, 309.1, 310, 316.1, 316.6, 316.7, 205.2, 505

[56] References Cited

U.S. PATENT DOCUMENTS

| | | | |
|---|---|---|---|
| 1,321,742 | 11/1919 | Hendricks | 248/505 |
| 2,502,714 | 4/1950 | Garnett | 248/505 X |
| 3,370,816 | 2/1968 | Michaud | 248/117.6 |
| 3,599,358 | 8/1971 | Butts | 38/107 |
| 3,895,797 | 7/1975 | Moore | 2/DIG. 6 X |
| 4,108,452 | 8/1978 | Baron | 2/DIG. 6 X |
| 4,417,710 | 11/1983 | Adair | 248/205.2 X |
| 4,557,451 | 12/1985 | Conway | 248/187 |
| 4,564,957 | 1/1986 | Scharf | 2/DIG. 6 X |
| 4,612,717 | 9/1986 | Alvarez | 38/104 |
| 4,813,641 | 3/1989 | Wilson | 248/309.1 X |

*Primary Examiner*—Andrew M. Falik

[57] ABSTRACT

An apparatus for securing an iron to an ironing board includes a strap attached to the upper surface of an ironing board cover. The strap is adapted to engage the handle of an iron which is standing on its heel. In the preferred embodiment, one face of a hook-and-loop arrangement is securely attached to the top surface of an ironing board, and its complementary surface is securely attached to the underside of the ironing board cover opposite the strap.

23 Claims, 3 Drawing Sheets

APPARATUS FOR SECURING AN IRON TO AN IRONING BOARD COVER

Field of The Invention

The present invention relates to an apparatus for securing an iron to an ironing board.

Background of the Invention

In the ironing of clothes, electric irons are very often damaged because they fall off the ironing board onto the floor. The iron may simply slide off the ironing board while it is being used, for example, when clothes are being moved around on the surface of the board. When not in use, electric irons tend to fall off the ironing board either when the ironing board is tilted or bumped or when the cord connecting the iron to an outlet is disturbed. Obviously, if the falling iron is heated, there can be additional damage by melting or scorching the floor covering, fire, or hand burns from trying to catch the falling iron.

Summary of The Invention

The present invention is an apparatus for securing an iron to an ironing board. The apparatus comprises an ironing board cover with releasable means to attach the iron thereto. The means for attaching the iron to the ironing board may be a releasably-securable strap adapted to engage the heel of an iron. The strap is adjustable so as to fit through the handle and around the heel of a standard iron of any typical size.

A preferred embodiment of the invention generally comprises a strap, adapted to releasably fit through the handle and around the heel of an iron, which is attached to an ironing board cover. Adjacent to this strap, on the underside of the cover, is an adhesive member which sticks to the surface of the ironing board. In this way the covering will be securely attached to the ironing board in the area underneath the strap.

Another preferred embodiment of the invention generally comprises a first fastening means, which is securely attached to the top surface of the ironing board itself. Engaging with this fastening means is a second fastening means, complementary to the first fastening means, which is attached to the underside of the ironing board cover. On the upper surface of this ironing board cover, opposite the complementary fastening means, is provided a small strap of a size and shape suitable for holding down a standard iron that is resting on its heel. The strap is intended to loop through the handle of the iron as it stands on its heel.

In this arrangement, an iron at rest on its heel is secured to an ironing board cover, which is in turn secured at the point of contact with the iron securely to the surface of the ironing board itself. In this way the iron is securely but releasably attached to the structure of the ironing board.

It is an object of the present invention to provide an ironing board cover which, in addition to the usual functions of an ironing board cover, includes means for securing an iron by its handle to the surface of the ironing board.

Brief Description of the Drawings

For the purpose of illustrating the invention, there is shown in the drawings a form which is presently preferred; it being understood, however, that this invention is not limited to precise arrangements and instrumentalities shown.

Detailed Description of the Drawings

Figure 1:
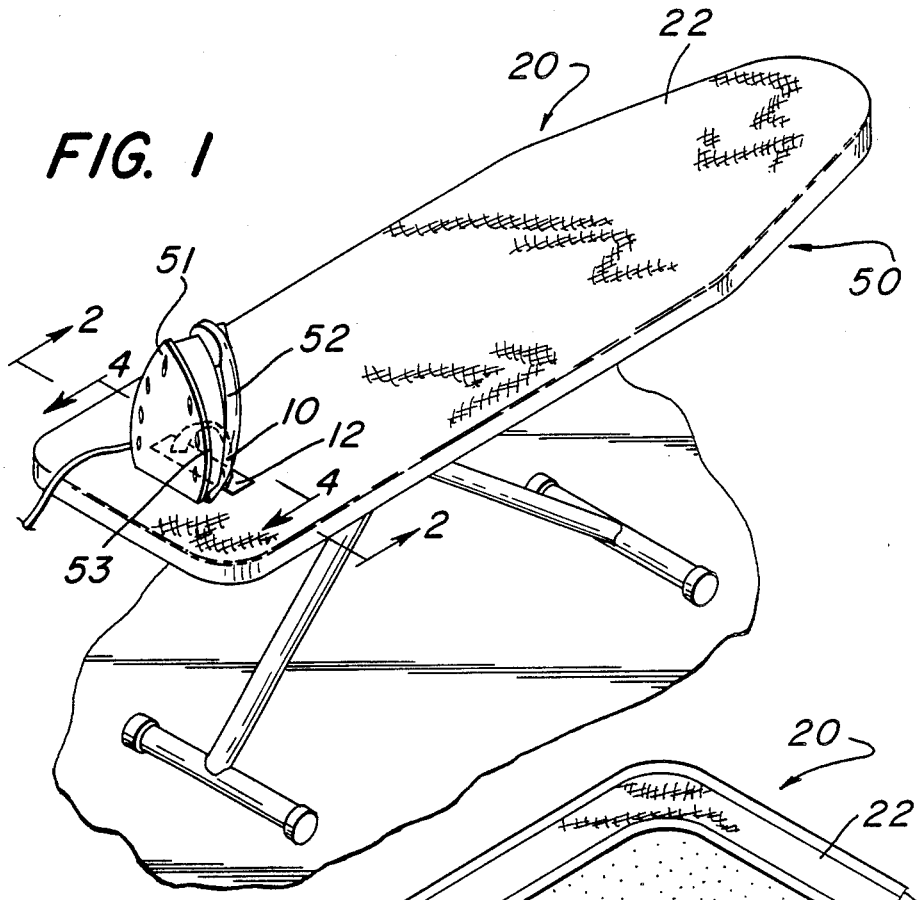
FIG. 1 is perspective view of an ironing board incorporating the present invention to securely hold an iron to one end of the ironing board.
Figure 1:
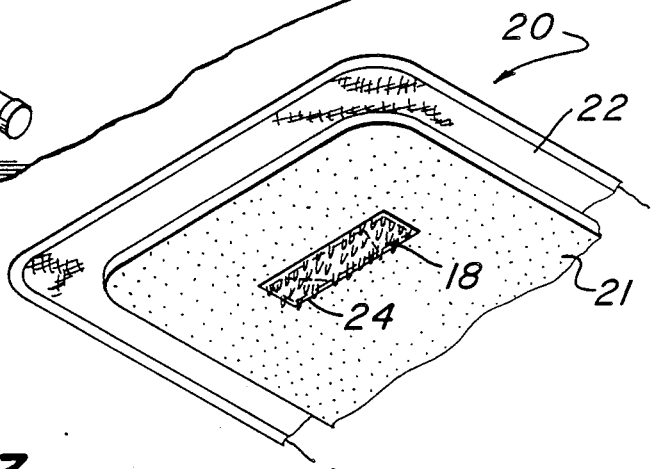

Referring to the drawings, wherein like numerals indicate like elements, there is shown in FIG. 1 an ironing board generally labeled 50. Ironing board 50 has the customary legs and top surface, the top surface having a tapered end, called the nose, the other end being called the heel. On the top surface of ironing board 50 is an ironing board cover generally labeled 20, which envelops the top and sides of the table surface. The outer layer of ironing board cover 20 may be a heat resistance sheet 22, such as that described in U.S. Pat. No. 4,484,400 by the same inventor, and incorporated herein by reference. Toward the heel end of the ironing board surface is an iron 51, which is in a standard resting position, standing on what is known as the heel of the iron. Strap 10 is attached to the surface of ironing board cover 20 and loops around the heel 53 of the iron, through the opening formed by handle 52 of the iron. In this way, strap 10 securely attaches the iron 51 to the ironing board cover 20.

What is referred to herein as an "ironing board covering" may be an ironing board covering of any design. The covering may comprise a textile or other sheet material, with or without an associated padding layer. Typically, ironing board covers will comprise a backing of polyurethane foam or other compressible material, disposed between the top layer of the cover and the surface of the ironing board. Other possible designs for the ironing board cover include those of U.S. Pat. Nos. 3,911,603; 4,043,062; or 4,603,494, or application Ser. No. 55,091 by the same inventor, incorporated herein by reference.

Figure 2:
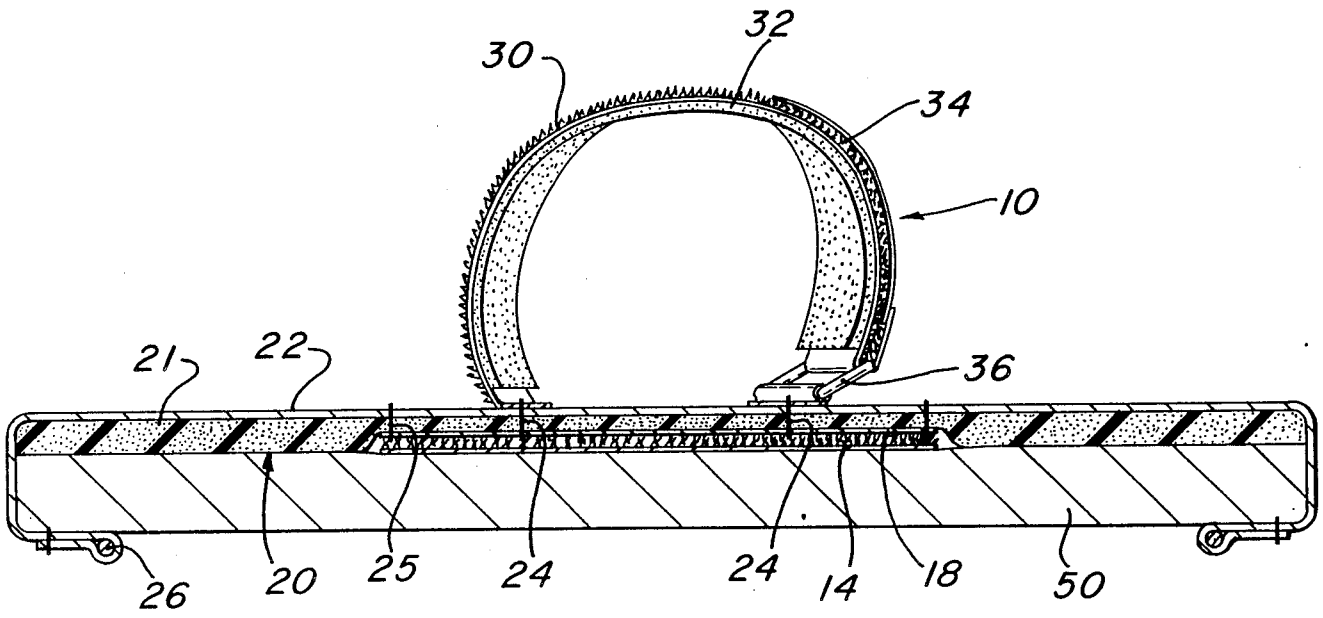
FIG. 2 is another view of a preferred embodiment of the present invention showing the adjustable, releasable strap.

FIG. 2 shows the strap generally marked 10 in detail. In the preferred embodiment, one end of the strap is securely sewed into the structure of ironing board cover 20. The main part of strap 10 comprises a length of a hook-and-loop arrangement. The hook-and-loop arrangement comprises two complementary portions of strap 10, marked 30 and 34, which when pressed together removably adhere to each other. Such hook-and-loop arrangements are generally known by the trademark "VELCRO".

Figure 4:
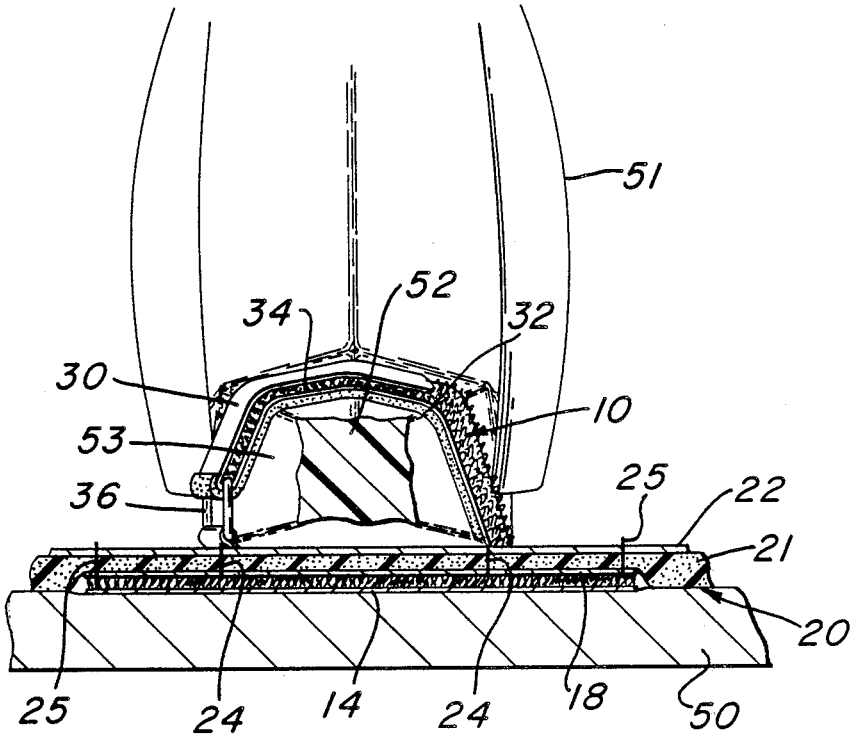
FIG. 4 is a cross-sectional view through line 4–4 of FIG. 1, show the operation of the present invention in securing an iron to an ironing board.

Complementary portion 30 of the hook-and-loop arrangement is adapted to pass through rectangular ring 36 and fold back over and into operative engagement with complementary portion 34, thus forming a closed loop as shown in FIG. 2. Ring 36 is fixed, such as by sewing, to the ironing board cover 20. To open the loop, the complementary hook-and-loop portions 30 and 34 are separated, and strap 10 is freed from the ring 36. To attach an iron, strap 10 is threaded through the handle of an iron and re-inserted through ring 36, as shown in FIG. 4. The complementary portions of the hook-and-loop arrangement are pressed together to lock the iron into place.

Strap 10 may be adapted to form a loop through the handle and around the heel of an iron by other means as well, such as a buckle, button, or snap. The strap 10 may include means for frictionally engaging the iron. For example, on the underside of portion 30 of strap 10 is a strip 32, which is made of a tacky or sticky substance, such as foam rubber or latex, which through frictional contact with the heel of the iron serves to prevent any twisting or sliding of the iron within the strap.

Although securement to the ironing board cover 20 may be sufficient for preventing the iron from falling as the result of a mild disturbance, a preferred mode of the invention is an arrangement whereby the iron is strapped to the ironing board cover, and the ironing board cover is in turn securely fixed to the surface of ironing board 50. In this way, the iron will effectively be secured to the structure of ironing board 50, with a resulting enhancement in stability.

One arrangement for enhancing stability of the iron on the ironing board involves securely attaching an adhesive member to the underside of the ironing board cover so it will be underneath the attachment points of the strap to the covering. The adhesive member, such as a peel-off adhesive rectangle, will stick to the surface of the ironing board 50, causing a firm attachment of the ironing board cover to the ironing board at the area of the strap. With this firm attachment, a disturbance to the ironing board will not cause the strapped-in iron to fall off, pulling off the covering as well.

Figure 3:
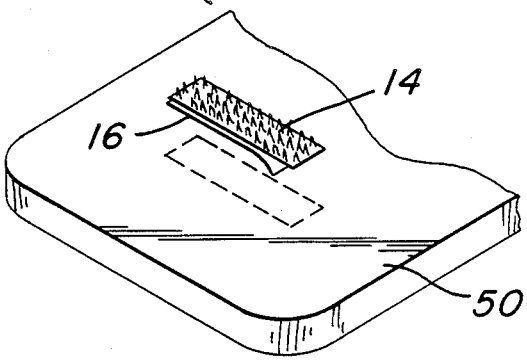
FIG. 3 is an exploded view of the relationship between the top surface of the ironing board itself, and the underside of the ironing board cover.

FIG. 3 is an exploded view of another mode of the present invention, showing the interaction between the surface of the ironing board 50 and the underside of the ironing board cover 20. Towards the heel of the ironing board is adhesively mounted a portion of a hook-and-loop arrangement 14. This hook-and-loop arrangement may be securely attached to the surface of the ironing board by adhesive means. The portion of hook-and-loop substance 14 may have a removable peel-off backing 16. Adhesive back 16 is removed and hook-and-loop arrangement 14 is placed on the surface of the ironing board in a position corresponding to a complementary portion of hook-and-loop material 18 which is sewed firmly onto the underside of the ironing board cover 20. In this way, when ironing board cover 20 is attached in a conventional way onto ironing board 50, the complementary hook-and-loop portions 14 and 18 will be in contact with each other, thus effecting a secure attachment between the two hook-and-loop portions, thereby effecting a secure attachment of the ironing board cover to the ironing board.

The upper hook-and-loop portion 18 has sewn to it with thread 24 the strap 10, which engages the handle of the iron. Thread 24, which can be clearly seen in the cross-sectional view of FIG. 2, engages the upper hook-and-loop portion 18, the underside 21 of the ironing board cover 20, the upper section of the ironing board cover 22 and the area of the ironing board cover whereon the strap 10 is anchored. Strap 10 is thus securely anchored to the upper hook-and-loop portion 18, and is thereby secured through the lower hook-and-loop portion 14 to the structure of ironing board 50. Additional stitching 25 adds further stability to strap 10 and hook-and-loop portion 18.

FIG. 4 shows how the strap 10 engages an iron 51 resting on its heel 53, by fitting through the opening formed by the handle (shown broken off at 52). The strap 10 is adjustable in length and can flex to conform to the shape of any standard iron.

In the present embodiment the ironing board cover 20 has a polyurethane foam backing 21, a heat resistant surface 22, and is attached to the ironing board by means of a drawstring 26. However, the actual structure of the ironing board cover and its means for attachment to the ironing board is a design choice not essential to the present invention. Similarly, the first and second fastening means need not be a hook-and-loop arrangement, but may be any means for removably but securely attaching two surfaces, such as snaps.

The present invention may be embodied in other specific forms without departing from the spirit or essential attributes thereof and, accordingly, reference should be made to the appended claims, rather than to the foregoing specifications, as indicating the scope of the invention.

I claim:

1. An apparatus for securing an iron to an ironing board, comprising:

an ironing board cover; and a strap attached to the top surface of said ironing board cover, for releasably engaging the handle of an iron, which strap is adjustable in length.

2. An apparatus as in claim 1, wherein said strap engages said heel by means of a hook-and-loop arrangement.

3. An apparatus as in claim 1, wherein said strap engages said heel by means of a buckle.

4. An apparatus as in claim 1, wherein said strap engages said heel by means of a button.

5. An apparatus as in claim 1, wherein said strap engages said heel by means of a snap.

6. An apparatus as in claim 1, wherein said strap includes means for frictionally engaging said iron.

7. An apparatus for securing an iron to an ironing board having a top surface, comprising:

an ironing board cover having a top surface and an underside;

a strap attached to said top surface of said ironing board cover, which strap is adapted to releasably engage the handle of an iron; and an adhesive member attached to said underside of said ironing board cover, adjacent to said strap, said adhesive member adapted to adhere to said top surface of said ironing board.

8. An apparatus as in claim 7, wherein said strap engages said heel by means of a hook-and-loop arrangement.

9. An apparatus as in claim 7 wherein said strap engages said heel by means of a buckle.

10. An apparatus as in claim 9, wherein said strap engages said heel by means of a button.

11. An apparatus as in claim 9, wherein said strap engages said heel by means of a snap.

12. An apparatus as in claim 9, wherein said strap is adjustable in length.

13. An apparatus as in claim 9, wherein said strap include for frictionally engaging said iron.

14. An apparatus for securing an iron to an ironing board, comprising:

an ironing board cover, having a top surface and an underside;

first releasable fastening means, attached to the top surface of an ironing board;

complimentary releasable fastening means adapted to be attached to said first fastening means, secured to said underside of said ironing board cover; and a strap, secured to said top surface of said ironing board cover in an area of said ironing board cover adjacent said complimentary fastening means, said strap being adapted to releasably engage the handle of an iron.

15. An apparatus as in claim 14, wherein said first releasable fastening means is adhesively attached to said top surface of an ironing board.

16. An apparatus as in claim 14, wherein said first and complementary fastening means are attached by a hook-and-loop arrangement.

17. An apparatus as in claim 14, wherein said strap is sewed into said ironing board cover and said complementary fastening means.

18. An apparatus as in claim 14, wherein said strap engages said heel by means of a hook-and-loop arrangement.

19. An apparatus as in claim 14, wherein said strap engages said heel by means of a buckle.

20. An apparatus as in claim 14, wherein said strap engages said heel by means of a button.

21. An apparatus as in claim 14, wherein said strap engages said heel by means of a snap.

22. An apparatus as in claim 14, wherein said strap is adjustable in length.

23. An apparatus as in claim 14, wherein said strap includes means for frictionally engaging said iron.

* * * * *